US007304632B2

(12) United States Patent
Kodama et al.

(10) Patent No.: US 7,304,632 B2
(45) Date of Patent: Dec. 4, 2007

(54) LIQUID-CRYSTAL DISPLAY DRIVING CIRCUIT AND METHOD

(75) Inventors: Hidetaka Kodama, Tokyo (JP); Kenji Kokuda, Tokyo (JP); Hiroshi Furuya, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 403 days.

(21) Appl. No.: 10/650,796

(22) Filed: Aug. 29, 2003

(65) Prior Publication Data

US 2004/0041763 A1 Mar. 4, 2004

Related U.S. Application Data

(63) Continuation of application No. 09/718,620, filed on Nov. 24, 2000, now Pat. No. 6,642,916.

(51) Int. Cl.
*G09G 3/36* (2006.01)

(52) U.S. Cl. ..... 345/100; 345/87; 345/89; 345/98; 345/100; 345/204

(58) Field of Classification Search ..... 345/87–89, 345/91, 92, 90, 94–96, 98, 100, 204, 211–213
See application file for complete search history.

(56) References Cited

U.S. PATENT DOCUMENTS 3,654,608 A * 4/1972 Marlowe et al. ..... 340/825.79
4,795,239 A * 1/1989 Yamashita et al. ..... 345/87
4,870,396 A * 9/1989 Shields ..... 345/90
5,585,815 A * 12/1996 Nakashima et al. ..... 345/100
5,610,628 A * 3/1997 Yamamoto et al. ..... 345/100
5,646,643 A * 7/1997 Hirai et al. ..... 345/100
5,682,175 A * 10/1997 Kitamura ..... 345/98
5,748,165 A * 5/1998 Kubota et al. ..... 345/96
5,764,206 A * 6/1998 Koyama et al. ..... 345/80
5,790,092 A * 8/1998 Moriyama ..... 345/96
5,818,413 A * 10/1998 Hayashi et al. ..... 345/100
5,844,535 A * 12/1998 Itoh et al. ..... 345/92
5,949,396 A * 9/1999 Lee ..... 345/87
6,049,321 A * 4/2000 Sasaki ..... 345/99
6,166,725 A * 12/2000 Isami et al. ..... 345/209
6,172,663 B1 * 1/2001 Okada et al. ..... 345/96
6,243,062 B1 * 6/2001 den Boer et al. ..... 345/91
6,642,916 B1 * 11/2003 Kodama et al. ..... 345/100

* cited by examiner

*Primary Examiner*—Richard Hjerpe
*Assistant Examiner*—Jennifer T Nguyen
(74) *Attorney, Agent, or Firm*—Rabin & Berdo, PC

(57) ABSTRACT

A driving circuit for an active-matrix liquid-crystal display short-circuits at least two of the signal lines in the matrix at times of transitions of signal-line potentials in the matrix. Charge stored in the parasitic capacitances of the signal lines is thereby recycled from one signal line to another, reducing the current consumption of the driving circuit. When alternating-current driving is employed, current consumption can also be reduced by reducing the frequency with which signal lines are driven from one side of a center potential to the other side.

6 Claims, 16 Drawing Sheets

LIQUID-CRYSTAL DISPLAY DRIVING CIRCUIT AND METHOD

This application is a continuation of application Ser. No. 09/718,620, which was filed on Nov. 24, 2000 now U.S. Pat. No. 6,642,916.

BACKGROUND OF THE INVENTION

The present invention relates to a circuit and method for driving a liquid-crystal display, such as an active-matrix display employing thin-film transistors.

Active-matrix liquid-crystal displays or LCDs are widely employed in, for example, portable computers, where they provide the advantages of high-speed response and reduced crosstalk. In a typical active-matrix LCD, for each of the three primary colors, each picture element or pixel has a thin-film transistor (TFT) that is switched on and off by a signal received from a gate line, and a liquid-crystal capacitor that charges or discharges through a source line when the TFT is switched on. The source and gate lines form a matrix in which the gate lines are activated one at a time, and the source lines carry signals representing the displayed intensities of the picture elements. In the alternate-current or AC driving system that is usually employed with active-matrix LCDs, adjacent liquid-crystal capacitors are charged in opposite directions centered around a common potential. A more detailed description of the active-matrix circuit configuration and AC driving scheme will be given later.

In the AC driving scheme, as successive gate lines are activated, the voltage of each source line must swing alternately above and below the common potential. The voltage swings on the source lines are thereby doubled, as compared with direct-current driving. A resulting problem is that the time needed to charge the parasitic capacitances of the source lines is increased, current consumption is similarly increased, and large source-line driving circuits are needed. The large charging and discharging currents furthermore generate electrical noise.

Although the gate lines are not driven in an AC manner, they also have parasitic capacitances that must be charged and discharged. The charging and discharging of the gate lines similarly takes time, consumes current, generates noise, and requires large driving circuits.

SUMMARY OF THE INVENTION

It is accordingly an object of the present invention to reduce the current consumed in charging the parasitic capacitances of signal lines in a liquid-crystal display.

Another object of the invention is to reduce the time needed for charging the parasitic capacitances of signal lines in a liquid-crystal display.

Yet another object is to reduce electrical noise in a liquid-crystal display.

Still another object is to reduce the size and cost of the driving circuits of a liquid-crystal display.

The invented driving circuit drives a liquid-crystal display having first signal lines running in one direction, second signal lines running in another direction, switching elements controlled by the first signal lines, disposed at the intersections of the first and second signal lines, and liquid-crystal capacitors disposed at these same intersections and coupled through the switching elements to the second signal lines.

The driving circuit comprises a plurality of first drivers for sequentially driving the first signal lines to active and inactive levels, thereby switching the switching elements on and off, and a plurality of second drivers that drive the second signal lines with signals representing picture-element intensities.

According to a first aspect of the invention, a switching circuit is coupled to the second signal lines. At transition times when any of the first signal lines change between the active and inactive levels, the switching circuit disconnects the second signal lines from the second drivers, and places the second signal lines in a short-circuited state. The second signal lines may be short-circuited to a fixed potential, or short-circuited to each other.

According to a second aspect of the invention, a switching circuit is coupled to the first signal lines. When a pair of first signal lines changes between the active and inactive levels, the switching circuit disconnects that pair of first signal lines from the corresponding first drivers, and places that pair of first signal lines in a short-circuited state. The short-circuited pair of first signal lines may be short-circuited to a fixed potential, or short-circuited to each other.

The switching circuits in both the first and second aspects of the invention may incorporate resistors to limit the peak current flow on the short-circuited signal lines.

According to a third aspect of the invention, the second drivers drive each of the second signal lines alternately above and below a certain center potential. Each second signal line stays at potentials equal to or greater than the center potential while a plurality of first signal lines are being driven to the active level, then stays at potentials equal to or less than the center potential while another plurality of first signal lines are being driven to the active level.

The first and second aspects of the invention recycle charge from one signal line to another through the short circuits, thereby reducing current consumption, reducing electrical noise, and enabling the signal lines to be driven more rapidly, or to be driven by drivers with less driving capability, hence with smaller size and lower cost.

The third aspect of the invention provides similar effects by reducing the frequency with which the second signal lines are driven from one side of the center potential to the opposite side.

DETAILED DESCRIPTION OF THE INVENTION

Embodiments of the invention will be described with reference to the attached illustrative drawings, following a description of the circuit elements that are common to these embodiments and the conventional art, and a description of the AC driving scheme employed in the conventional art.

Figure 1:
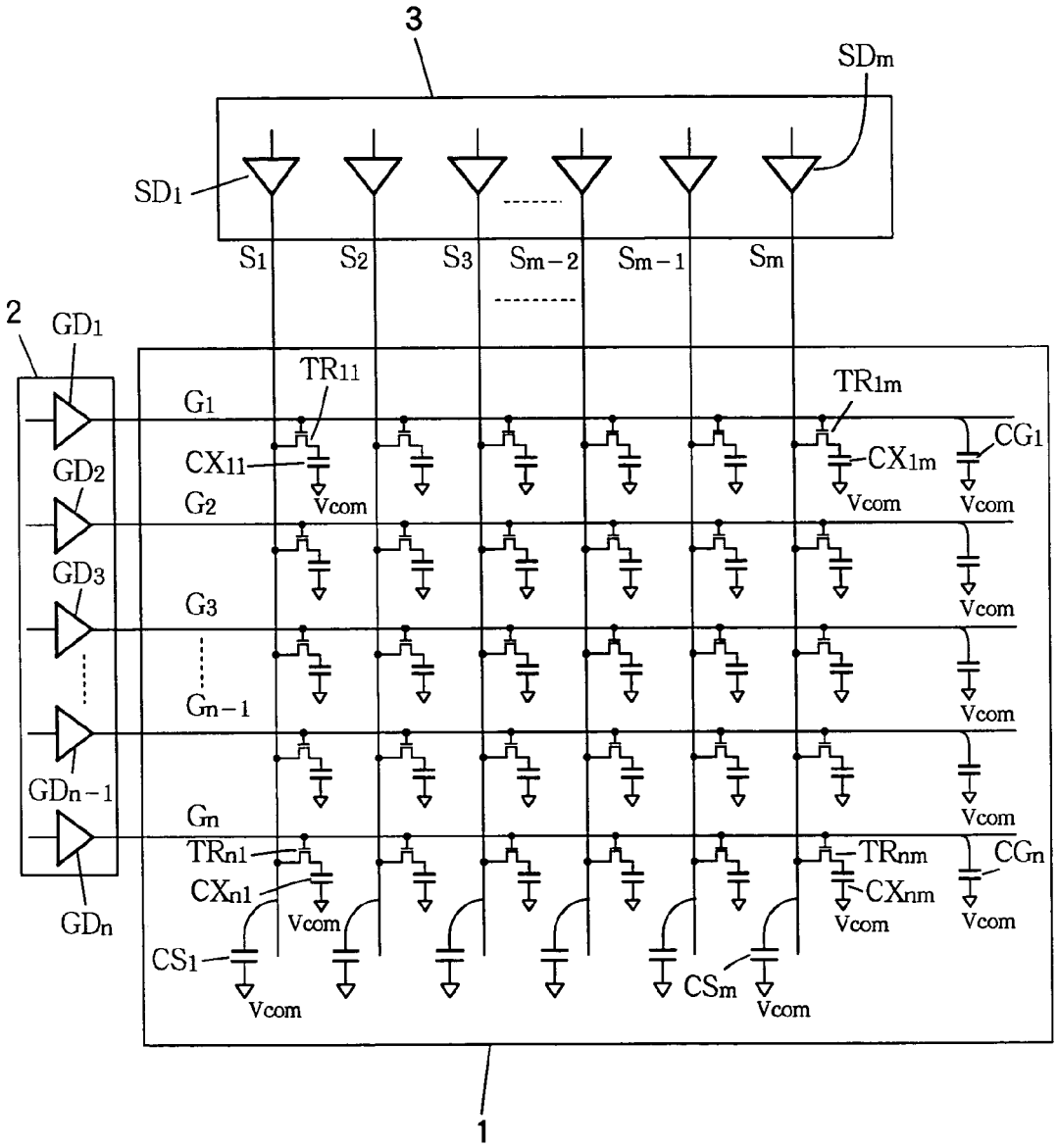
FIG. 1 PRIOR ART
FIG. 1 is a circuit diagram of a conventional active-matrix LCD.

Referring to FIG. 1, a conventional active-matrix LCD comprises an LCD panel 1, a gate-line driving circuit 2, and a source-line driving circuit 3. The LCD panel 1 comprises a liquid crystal encapsulated between a pair of flat transparent plates. A matrix of gate lines $G_1$ to $G_n$, running horizontally in the drawing, and source lines $S_1$ to $S_m$, running vertically in the drawing, is formed on one of the transparent plates. Thin-film transistors $TR_{11}$ to $TR_{nm}$ are formed at the intersections of the gate lines and source lines. Each thin-film transistor $TR_{ij}$ a has a gate terminal coupled to the corresponding gate line $G_i$, a source terminal coupled to the corresponding source line $S_j$, and a drain terminal coupled to one electrode of a corresponding liquid-crystal capacitor $CX_{ij}$ (where i is an integer from one to n, and j is an integer from one to m). As their other electrodes, the liquid-crystal capacitors $CX_{11}$ to $CX_{nm}$ share a common electrode formed on the opposing transparent plate. The common electrode is held at a fixed potential $V_{com}$. (The transparent plates, liquid crystal, and common electrode are not explicitly shown in the drawing.)

As the source lines $S_1$ to $S_m$ also face the common electrode, substantial parasitic capacitances $CS_1$ to $CS_m$ exist between the source lines and the common electrode. Similarly, parasitic capacitances $CG_1$ to $CG_n$ exist between the gate lines $G_1$ to $G_n$ and the common electrode.

The gate-line driving circuit 2 comprises gate drivers $GD_1$ to $GD_n$ that drive the corresponding gate lines $G_1$ to $G_n$ to an active potential, referred to below as the high level, to switch on the connected thin-film transistors, and to an inactive potential, referred to below as the low level, to switch the thin-film transistors off.

The source-line driving circuit 3 comprises source drivers $SD_1$ to $SD_m$ that drive the corresponding source lines $S_1$ to $S_m$ to potentials equal to, greater than, or less than a certain center potential. The center potential is equal to, or nearly equal to, $V_{com}$. The output potentials of the source drivers can be varied in, for example, sixty-four steps on each side of the center potential, enabling sixty-four intensity levels to be displayed.

The circuit elements shown in FIG. 1 are also present in the embodiments of the invention that will be described later, and will be denoted by the same reference characters, without repeated descriptions. The parasitic capacitances $CS_1$ to $CS_m$ and $CG_1$ to $CG_n$ are also present, even when not shown in the drawings.

Figure 2:
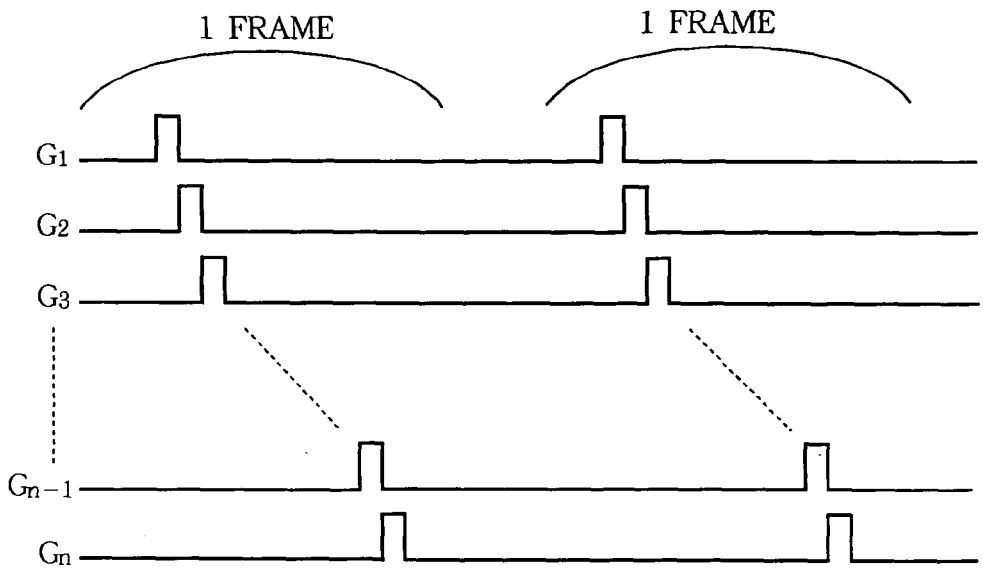
FIG. 2 PRIOR ART
FIG. 2 is a timing diagram illustrating a conventional gate-line driving scheme.

FIG. 2 illustrates the conventional gate-line driving scheme, the horizontal axis representing time. To display one frame of an image, the gate lines are driven to the high level in turn, in sequence from $G_1$ to $G_n$, only one gate line being driven high at a time. The same driving sequence is then repeated to display the next frame.

Figure 3:
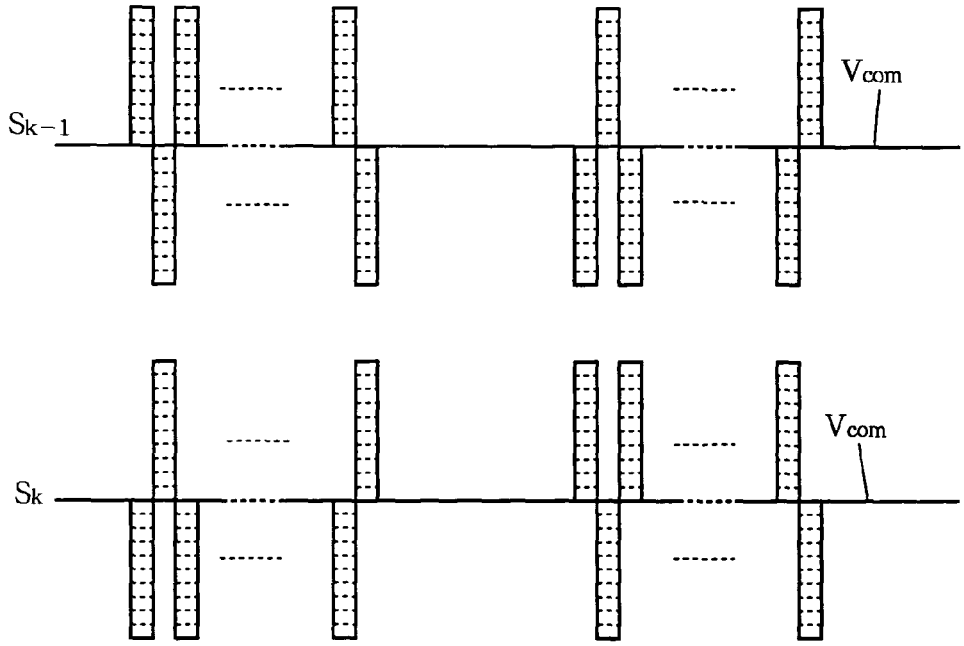
FIG. 3 PRIOR ART
FIG. 3 is a timing diagram illustrating a conventional source-line driving scheme.

FIG. 3 illustrates the conventional AC driving of two adjacent source lines $S_{k-1}$ and $S_k$, the horizontal axis representing time on the same scale as in FIG. 2. During the interval while the first gate line $G_1$ is high, each pair of mutually adjacent source lines is driven to potentials on opposite sides of the center potential, shown in the drawing as $V_{com}$. For example, source line $S_{k-1}$ is driven to a potential equal to or greater than $V_{com}$, while source line $S_k$ is driven to a potential equal to or less than $V_{com}$. The dotted lines within the waveforms indicate that there are a plurality of possible potential levels above and below $V_{com}$.

During the next interval, while gate line $G_2$ is being driven high, source lines such as $S_{k-1}$ that previously carried potentials equal to or greater than $V_{com}$ are now driven to potentials equal to or less than $V_{com}$. Similarly, source lines such as $S_k$ that previously carried potentials equal to or less than $V_{com}$ are now driven to potentials equal to or greater than $V_{com}$.

In the next interval, while gate line $G_3$ is high, the potentials of the source lines are again reversed with respect to the center potential $V_{com}$. The source line potentials continue to reverse around $V_{com}$ as each successive gate line is driven, until the end of the frame.

The parasitic capacitance of each source line is approximately one hundred fifty picofarads (150 pF), while the capacitance of one of the liquid-crystal capacitors, e.g. $CX_{11}$, is only about eight picofarads (8 pF). Most of the current generated by the source line drivers is therefore consumed in charging or discharging the parasitic capacitance of the source lines, rather than in charging or discharging the liquid-crystal capacitors.

Figure 4:
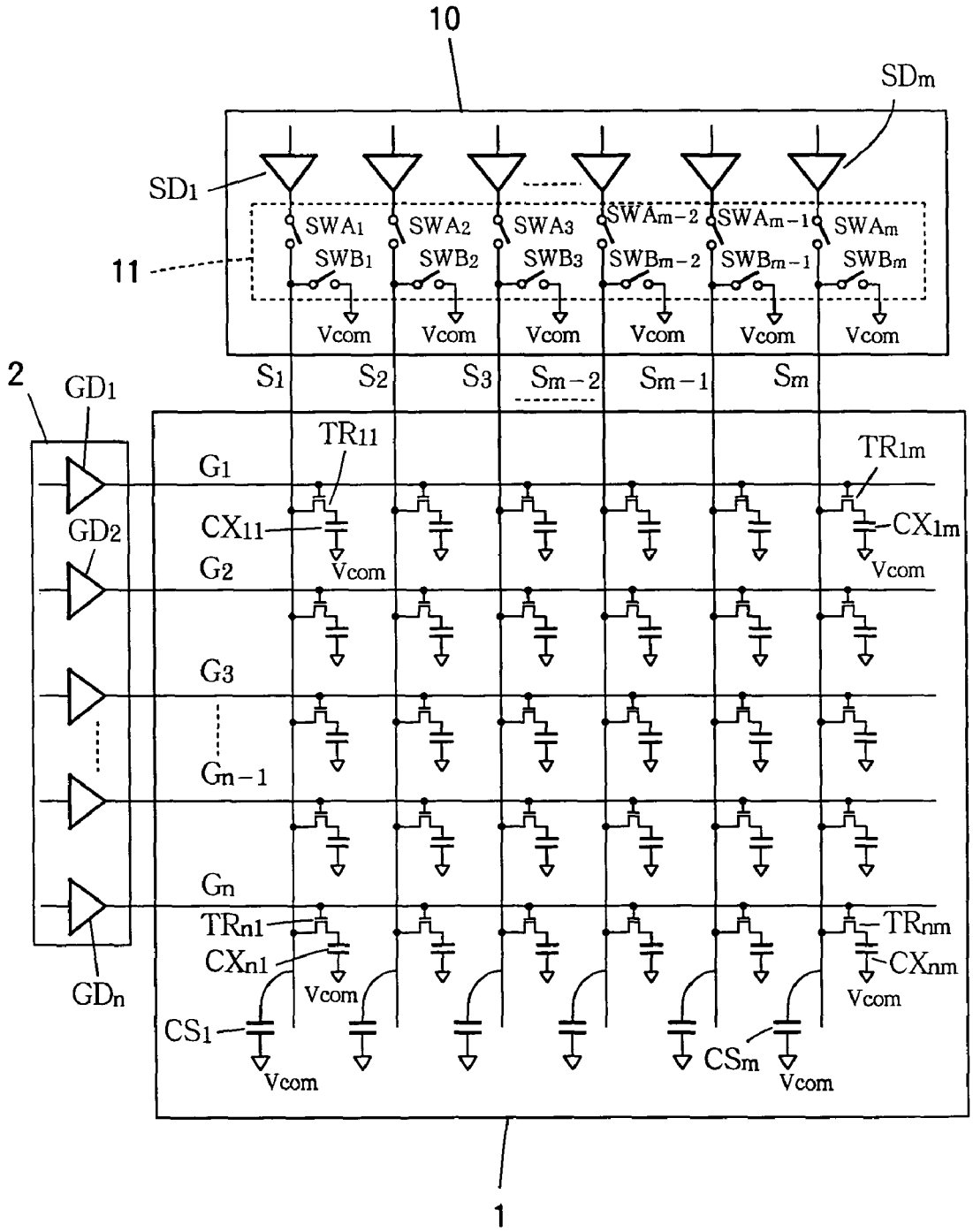
FIG. 4 is a circuit diagram of an active-matrix LCD embodying the present invention.

FIG. 4 shows a first embodiment of the invention. The LCD panel 1 and gate-line driving circuit 2 are similar to the conventional elements shown in FIG. 1.

The source-line driving circuit 10 in the first embodiment has a switching circuit 11 comprising switches $SWA_1$ to $SWA_m$ and $SWB_1$ to $SWB_m$. Switch $SWA_j$ couples source line $S_j$ to source driver $SD_j$ (j=1, . . . , m), while switch $SWB_j$ couples source line $S_j$ to a common electrode (not visible) held at the potential $V_{com}$ of the common electrode of the liquid-crystal capacitors. Switches $SWA_j$ and $SWB_j$ comprise, for example, field-effect transistors. This type of switching circuit 11 can easily be added to existing source-line driving circuit designs.

The switches $SWA_j$ and $SWB_j$ are controlled in synchronization with the gate drivers $GD_1$ to $GD_n$. Normally, switches $SWA_j$ are all closed, and switches $SWB_j$ are all open. At times of transition of the gate lines $G_1$ to $G_n$ between the high and low levels, however, for a brief interval switches $SWA_j$ are opened, and switches $SWB_j$ are closed, thereby disconnecting the source lines from the source drivers and short-circuiting the source lines to $V_{com}$.

Referring again to FIGS. 2 and 3, during most of the interval when gate line $G_1$ is high, switches $SWA_j$ are closed and switches $SWB_j$ are open, enabling the source drivers $SD_j$ to charge the liquid-crystal capacitors $CX_{1j}$ to signal levels representing the first row of picture-element intensities. As in the conventional art, half of the source lines, including source line $S_{k-1}$, are driven to potentials equal to or greater than a center potential approximately equal to $V_{com}$, while the other half of the source lines, including source line $S_k$, are driven to potentials equal to or less than the same center potential.

At the instant when gate driver $GD_1$ drives gate line $G_1$ from the high level to the low level, and gate driver $GD_2$ drives gate line $G_2$ from the low level to the high level, switches $SWA_j$ are all opened, and switches $SWB_j$ are all closed, shorting all of the source lines to $V_{com}$. Charge is thereby circulated from the source lines (e.g. $S_{k-1}$) at potentials above $V_{com}$ to the source lines (e.g. $S_k$) at potentials below $V_{com}$, speedily bringing all of the source lines to the $V_{com}$ potential, with little or no net current flow into or out of the source-line driving circuit 10.

After a brief interval, when this recycling of charge has been substantially completed, and when gate line $G_2$ has reached the high level and gate line $G_1$ has reached the low level, switches $SWB_j$ are opened and switches $SWA_j$ are closed, coupling the source lines $S_j$ to their source drivers $SD_j$. The source drivers then drive the source lines and liquid-crystal capacitors $CX_{2j}$ to signal levels representing the next row of picture-element intensities.

By recycling charge among the source lines, the first embodiment reduces the current consumption of the source-line driving circuit 10 to substantially half the value in the conventional art. Electrical noise on the power-supply and ground lines of the source drivers is correspondingly reduced. The frame rate can also be increased, because substantially half of the work of charging and discharging the source lines is done by the switching circuit 11, which has a lower internal impedance than the output impedance of the source drivers, and therefore permits faster charging and discharging.

Alternatively, for a given frame rate, the driving capability and hence the size of the source drivers can be reduced.

The first embodiment is not restricted to the AC driving scheme illustrated in FIGS. 2 and 3. The first embodiment provides the same effects in any driving scheme that simultaneously drives half of the source lines to potentials above a center potential substantially equal to $V_{com}$, and approximately half of the source lines to potentials below the center potential, and sometimes reverses the potentials of the source lines with respect to the center potential. The switching circuit operates to short-circuit the source lines to $V_{com}$ whenever the potentials of the source lines are about to be reversed with respect to the center potential.

Figure 5:
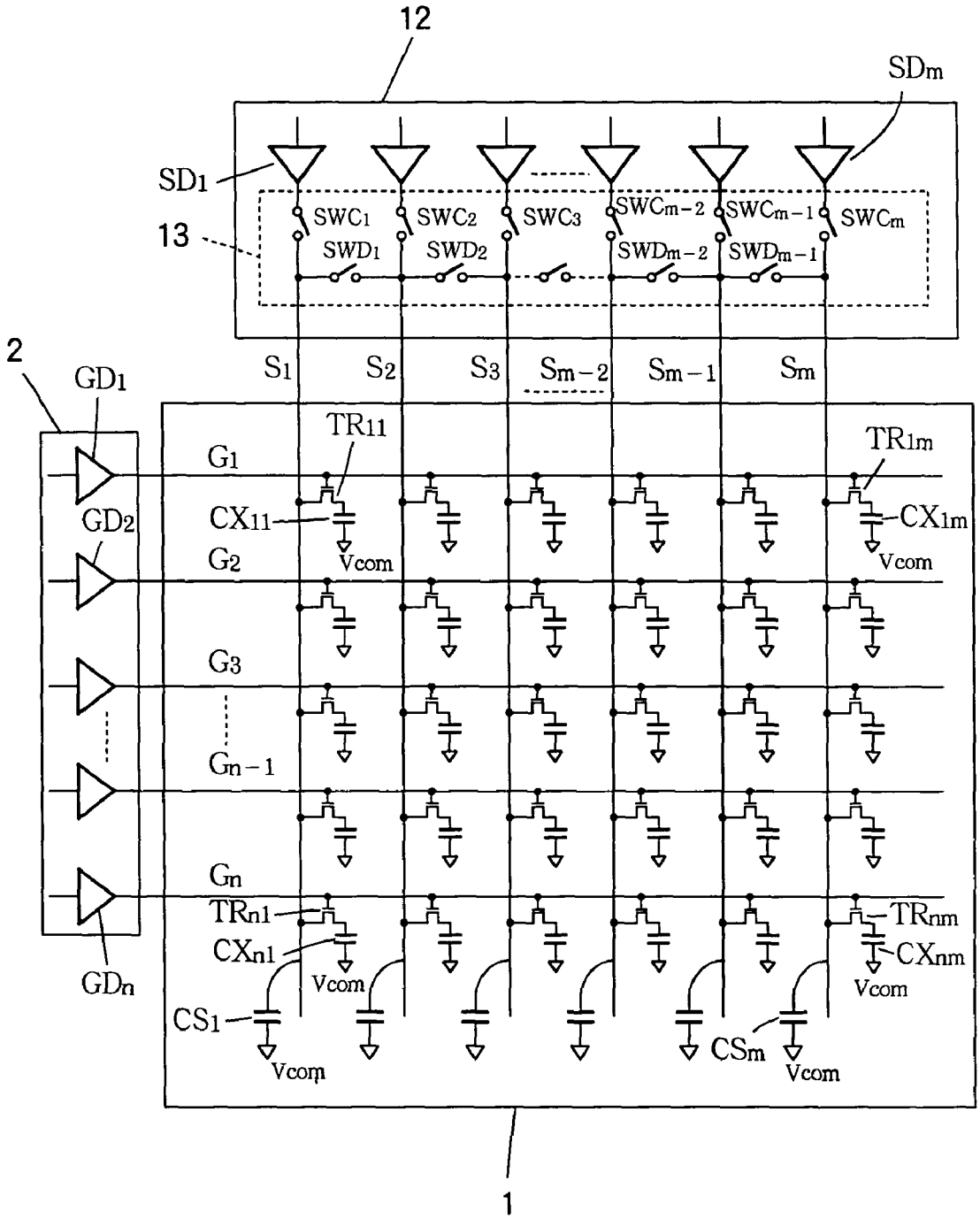
FIG. 5 is a circuit diagram of another active-matrix LCD embodying the present invention.

FIG. 5 shows a second embodiment of the invention. The LCD panel 1 and gate-line driving circuit 2 are similar to the conventional elements in FIG. 1.

The source-line driving circuit 12 in the second embodiment has a switching circuit 13 comprising switches $SWC_1$ to $SWC_m$ and $SWD_1$ to $SWD_{m-1}$. Switch $SWC_j$ couples source line $S_j$ to source driver $SD_j$ (j=1, . . . , m), while switch $SWD_j$ couples source line $S_j$ to source line $S_{j+1}$ (j=1, . . . , m−1). Switches $SWC_j$ and $SWD_j$ comprise, for example, field-effect transistors, and can easily be added to existing source-line driving circuit designs.

The control of switches $SWC_j$ and $SWD_j$ is analogous to the control of switches $SWA_j$ and $SWB_j$ in the first embodiment. Normally, switches $SWC_j$ are all closed, and switches $SWD_j$ are all open. At each transition of any of the gate lines $G_1$ to $G_n$ between the high and low levels, for a brief interval switches $SWC_j$ are opened, and switches $SWD_j$ are closed, thereby disconnecting the source lines from the source drivers and mutually short-circuiting all adjacent pairs of source lines.

The second embodiment operates in the same way as the first embodiment, except that when switches $SWD_j$ are closed, charge is circulated directly among the source lines, instead of being circulated through a common electrode held at the $V_{com}$ potential. The resulting potential of the short-circuited source lines is the average potential to which the source lines were driven during the preceding gate-line driving interval. This average potential will usually be close to $V_{com}$. The second embodiment provides substantially the same effects as the first embodiment, without the need for a separate electrode, held at the $V_{com}$ potential, to which the source lines can be short-circuited.

Figure 6:
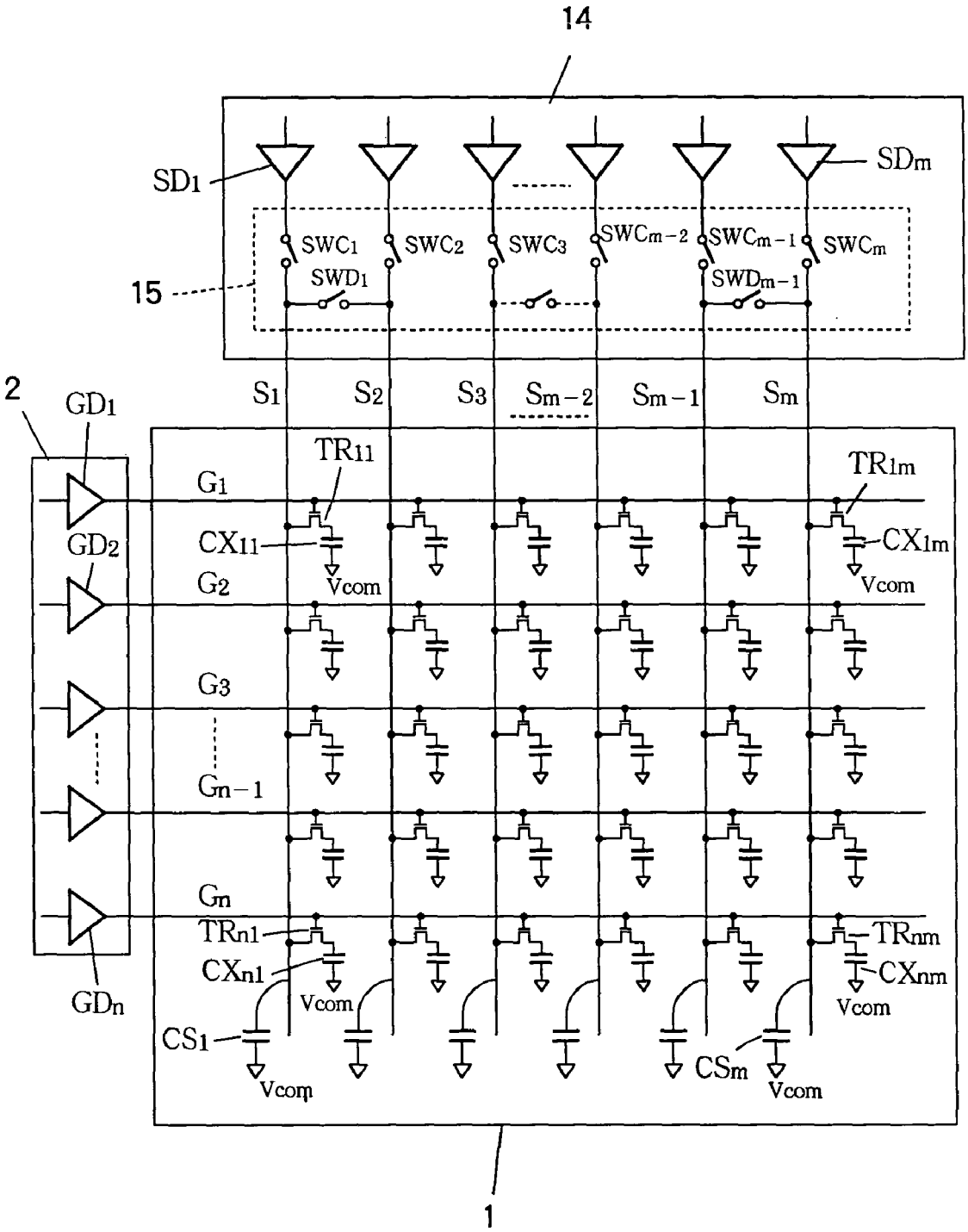
FIG. 6 is a circuit diagram of another active-matrix LCD embodying the present invention.

FIG. 6 shows a third embodiment of the invention. The LCD panel 1 and gate-line driving circuit 2 are similar to the conventional elements in FIG. 1.

The source-line driving circuit 14 in the third embodiment has a switching circuit 15 comprising switches $SWC_1$, $SWC_2$, . . . , $SWC_m$ and $SWD_1$, $SWD_3$, . . . , $SWD_{m-1}$. Switching circuit 15 is obtained from the switching circuit 13 of the second embodiment by removing the even-numbered switches $SWD_2$, $SWD_4$, . . . , $SWD_{m-2}$ that short-circuit adjacent source lines.

The third embodiment operates in the same way as the second embodiment, but when switches SWChd j (j=1, 2, . . . , m) are opened and switches $SWD_j$ (j=1, 3, . . . , m−1) are closed, each source line is short-circuited to just one adjacent source line. Since adjacent source lines are driven to potentials on opposite sides of a center potential approximately equal to $V_{com}$, each short-circuited pair of source lines is brought to a potential in the general vicinity of $V_{com}$.

The third embodiment accordingly provides generally the same effects as the second embodiment, while requiring fewer switches.

Figure 7:
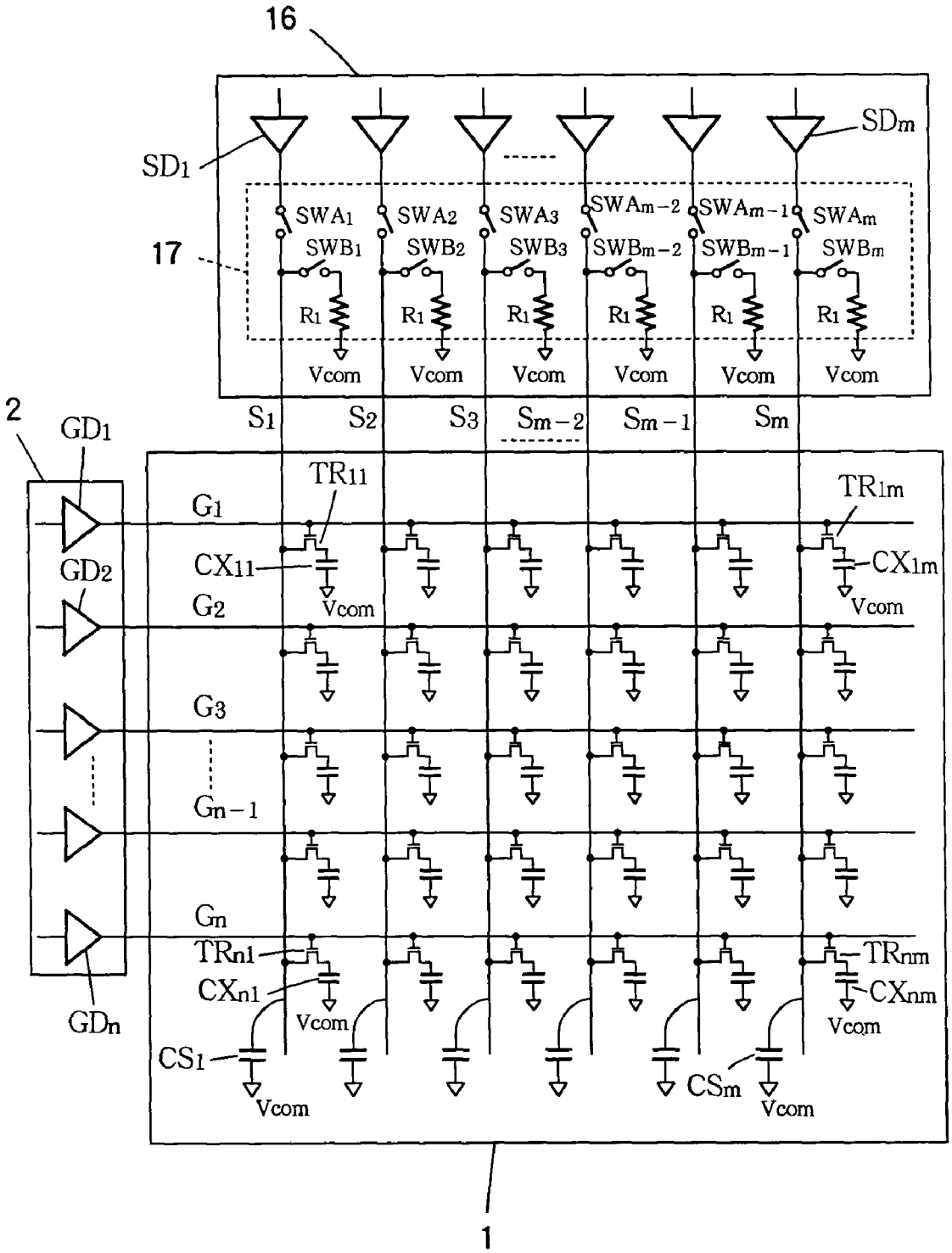
FIG. 7 is a circuit diagram of another active-matrix LCD embodying the present invention.

FIG. 7 shows a fourth embodiment of the invention. The LCD panel 1 and gate-line driving circuit 2 are similar to the conventional elements in FIG. 1.

The source-line driving circuit 16 in the fourth embodiment has a switching circuit 17 with the same switches $SWA_1$ to $SWA_m$ and $SWB_1$ to $SWB_m$ as in the first embodiment, but adds a resistor $R_1$ between each of switches $SWB_1$ to $SWB_m$ and the $V_{com}$ electrode. These resistors $R_1$ comprise, for example, field-effect transistors configured to provide a certain resistance; such resistors can easily be fabricated within the switching circuit 17. The resistors $R_1$ limit the peak current flow on the source lines $S_1$ to $S_m$ when switches $SWB_1$ to $SWB_m$ are closed.

In the first embodiment, when the source lines are short-circuited directly to $V_{com}$, if the source lines discharge to $V_{com}$ too rapidly, capacitive coupling between the source lines and gate lines may generate voltage noise on the gate lines in the LCD panel 1, possibly causing thin-film transistors $TR_{ij}$ to switch on at unwanted times. Transistors that are disposed far from the gate drivers $GD_i$ are particularly susceptible to such noise.

In the fourth embodiment, the resistors $R_1$ in the switching circuit 17 reduce the voltage noise on the gate lines by limiting the rate of discharge of the source lines. The resistance of the resistors $R_1$ should be high enough to prevent voltage noise problems, without being so high as to slow the flow of charge unduly. The fourth embodiment then provides substantially the same effects as the first embodiment, without possible unwanted switching of the thin-film transistors during the intervals when the source lines are short-circuited to $V_{com}$.

Figure 8:
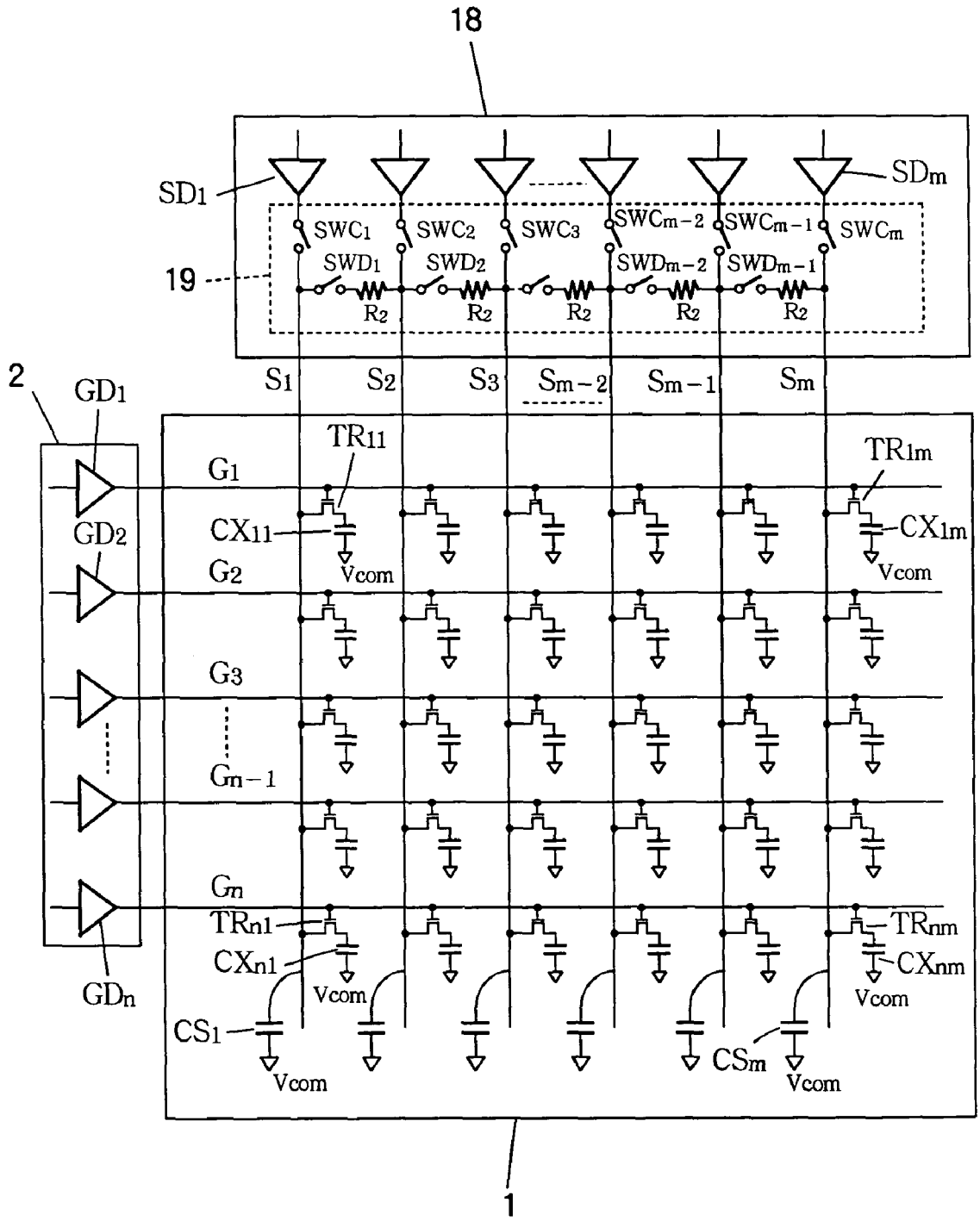
FIG. 8 is a circuit diagram of another active-matrix LCD embodying the present invention.

FIG. 8 shows a fifth embodiment of the invention. The LCD panel 1 and gate-line driving circuit 2 are similar to the conventional elements in FIG. 1.

The source-line driving circuit 18 in the fifth embodiment has a switching circuit 19 with the same switches $SWC_1$ to $SWC_m$ and $SWD_1$ to $SWD_{m-1}$ as in the second embodiment, but adds a resistor $R_2$ between each switch $SWD_j$ and source line $S_{j+1}$ (j=1, . . . , m−1). As in the fourth embodiment, these resistors $R_2$ can be fabricated as field-effect transistors configured to provide a certain resistance, limiting the peak current flow on the source lines $S_1$ to $S_m$ when switches $SWD_1$ to $SWD_{m-1}$ are closed.

The operation of the fifth embodiment can be understood from the description of the second and fourth embodiments. The fifth embodiment provides substantially the same effects as the second embodiment, while reducing voltage noise in the LCD panel 1 during the intervals while the source lines are mutually short-circuited.

As a variation of the fifth embodiment, the even-numbered switches $SWD_2$, $SWD_4$, . . . and their corresponding resistors $R_2$ can be eliminated, as in the third embodiment.

Figure 9:
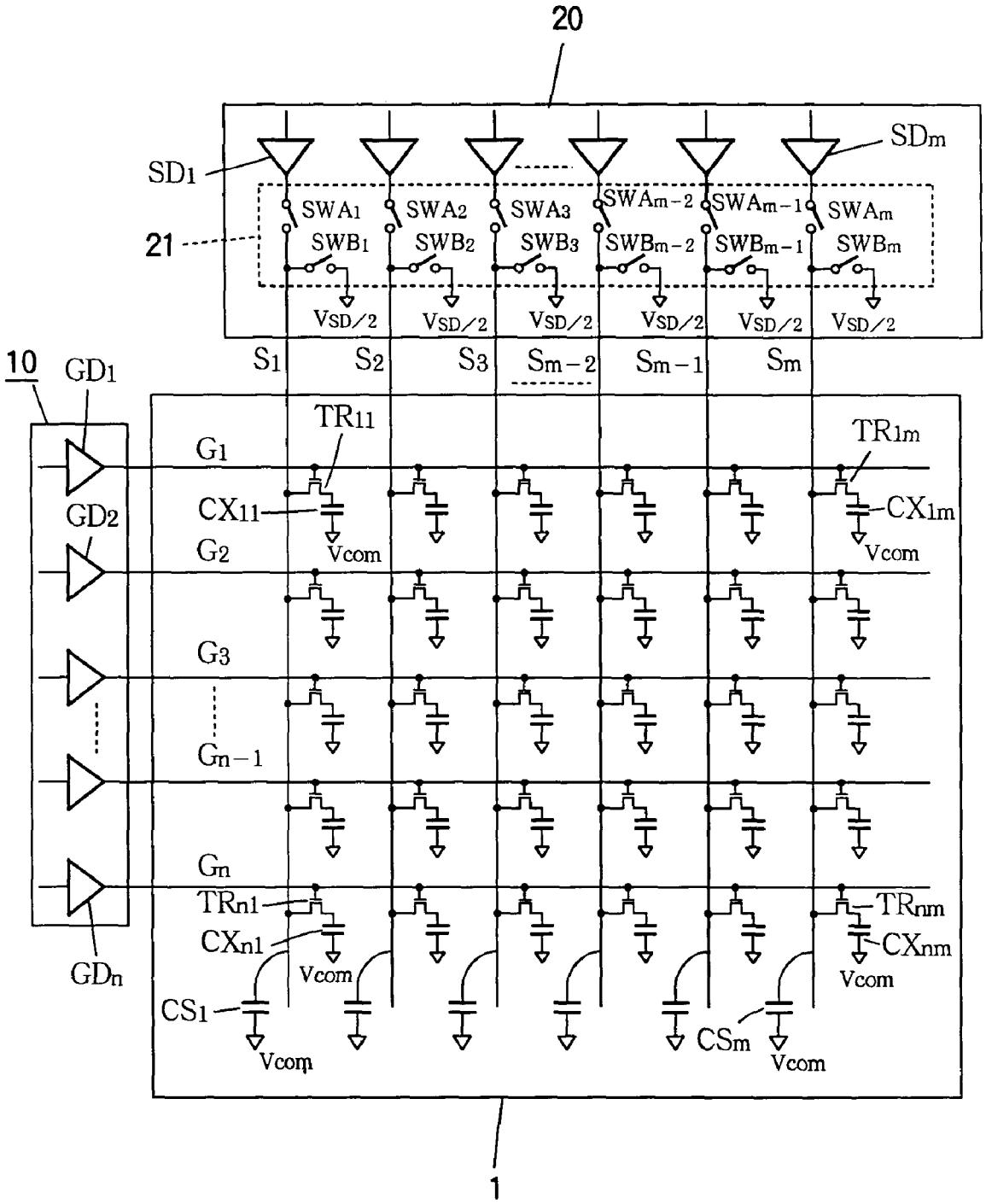
FIG. 9 is a circuit diagram of another active-matrix LCD embodying the present invention.

FIG. 9 shows a sixth embodiment of the invention. The LCD panel 1 and gate-line driving circuit 2 are similar to the conventional elements in FIG. 1.

The source-line driving circuit 20 in the sixth embodiment has a switching circuit 21 with the same switches $SWA_1$ to $SWA_m$ and $SWB_1$ to $SWB_m$ as in the first embodiment, but switches $SWB_1$ to $SWB_m$ couple the source lines to a common electrode held at a voltage $V_{SD/2}$ slightly different from the common potential $V_{com}$ applied to the liquid-crystal capacitors. $V_{SD/2}$ is the center potential of the driving range of the source drivers.

The driving range of the source drivers is not centered exactly around $V_{com}$ for the following reason. When a gate line is driven from the high level to the low level to switch off the connected thin-film transistors, the potential change on the gate line causes a slight shift $\Delta V_{GD}$ in the drain potential of the thin-film transistors in the LCD panel 1, due to capacitive coupling $C_{GD}$ between the gates and drains of the thin-film transistors. The drain potential of a thin-film transistor is also the potential of the connected electrode of a liquid-crystal capacitor, so the potentials stored in the liquid-crystal capacitors are shifted by $\Delta V_{GD}$ from the potentials to which the source lines were driven.

If the source lines are driven alternately above and below $V_{com}$, the $\Delta V_{GD}$ potential shift creates slight unwanted shifts in displayed intensity levels, and produces a slight display flicker. The source drivers in the sixth embodiment are therefore configured to drive the source lines to potentials alternately above and below a center potential $V_{SD/2}$ offset by $\Delta V_{GD}$ from the common potential $V_{com}$. Since the source-line driving circuit 20 provides $V_{SD/2}$ as a reference potential to the source drivers, it is a simple matter to supply $V_{SD/2}$ to the switches $SWB_1$ to $SWB_m$ as well.

The sixth embodiment operates in the same way as the first embodiment, but since the source lines are short-circuited to the true center potential $V_{SD/2}$ instead of $V_{com}$, the average total current flow between the source lines and the common $V_{SD/2}$ electrode has no direct-current component. Current consumption is therefore reduced even more than in the first embodiment.

A similar modification can be made to the fourth embodiment by coupling the resistors $R_1$ to a common electrode held at $V_{SD/2}$ instead of $V_{com}$.

Figure 10:
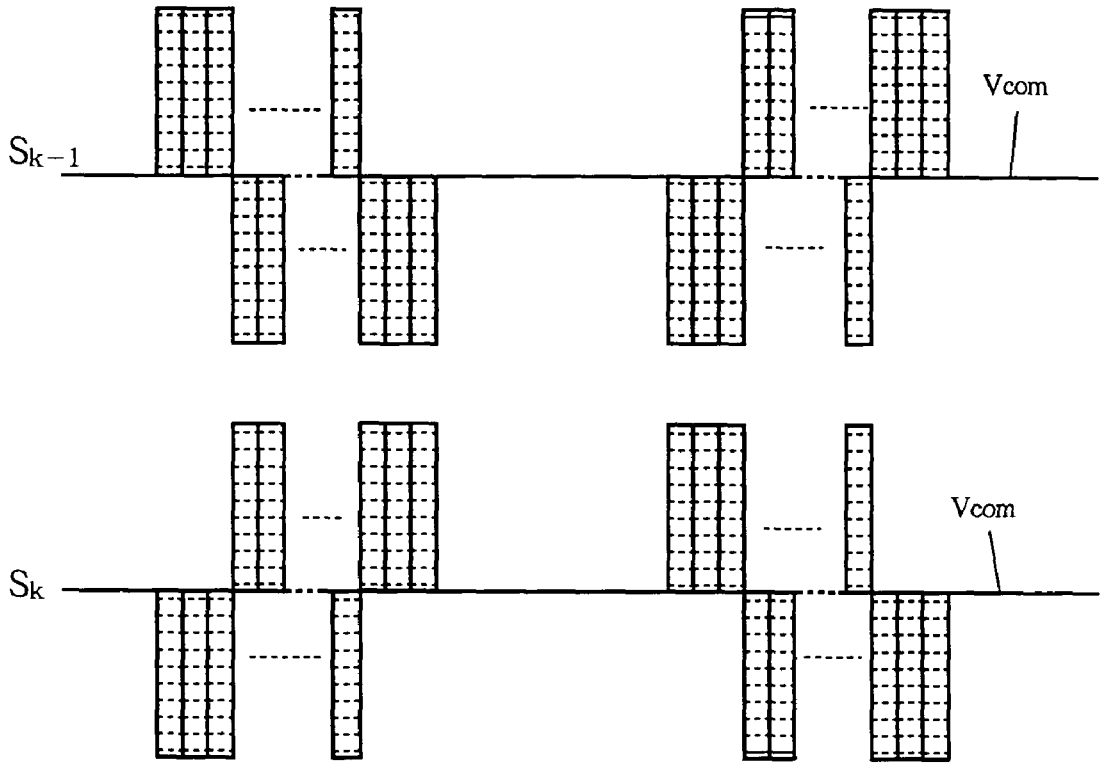
FIG. 10 is a timing diagram of a source-line driving scheme according to the present invention.

As a seventh embodiment of the invention, FIG. 10 illustrates a method of driving the source lines in which source line $S_{k-1}$ is driven to potentials equal to or greater than $V_{com}$ while the first three gate lines $G_1$, $G_2$, and $G_3$ are driven high, then to potentials equal to or less than $V_{com}$ while the next three gate lines $G_4$, $G_5$, and $G_6$ are driven high, and so on in a similar manner, the driving potential being reversed with respect to $V_{com}$ only one-third as often as in the conventional art. Mutually adjacent source lines, such as $S_{k-1}$ and $S_k$, are still driven in opposite directions from $V_{com}$, as shown.

This driving method can be practiced with the conventional driving circuit shown in FIG. 1. Since adjacent picture elements tend to have similar intensities, as successive gate lines are activated, the signal levels on the source lines tend not to change very much, except at times of reversal with respect to $V_{com}$. In the seventh embodiment, current consumption at the times when gate lines $G_2$, $G_3$, $G_5$, . . . are being driven high is greatly reduced. The source-line driving circuit consumes a large amount of current only when every third gate line ($G_1$, $G_4$, . . . ) is driven high.

This driving method can also be combined with any of the preceding embodiments of the invention, short-circuiting the source lines only when every third gate line ($G_1$, $G_4$, . . . ) is driven high. $V_{SD/2}$ may be substituted for $V_{com}$, as in the sixth embodiment.

The driving method of the seventh embodiment can be generalized by reversing the driving potential with respect to $V_{com}$ (or $V_{SD/2}$) once every N gate lines, where N is any integer equal to or greater than two.

The preceding embodiments have been concerned with the source-line driving circuit. The following embodiments are concerned with the gate-line driving circuit.

Figure 11:
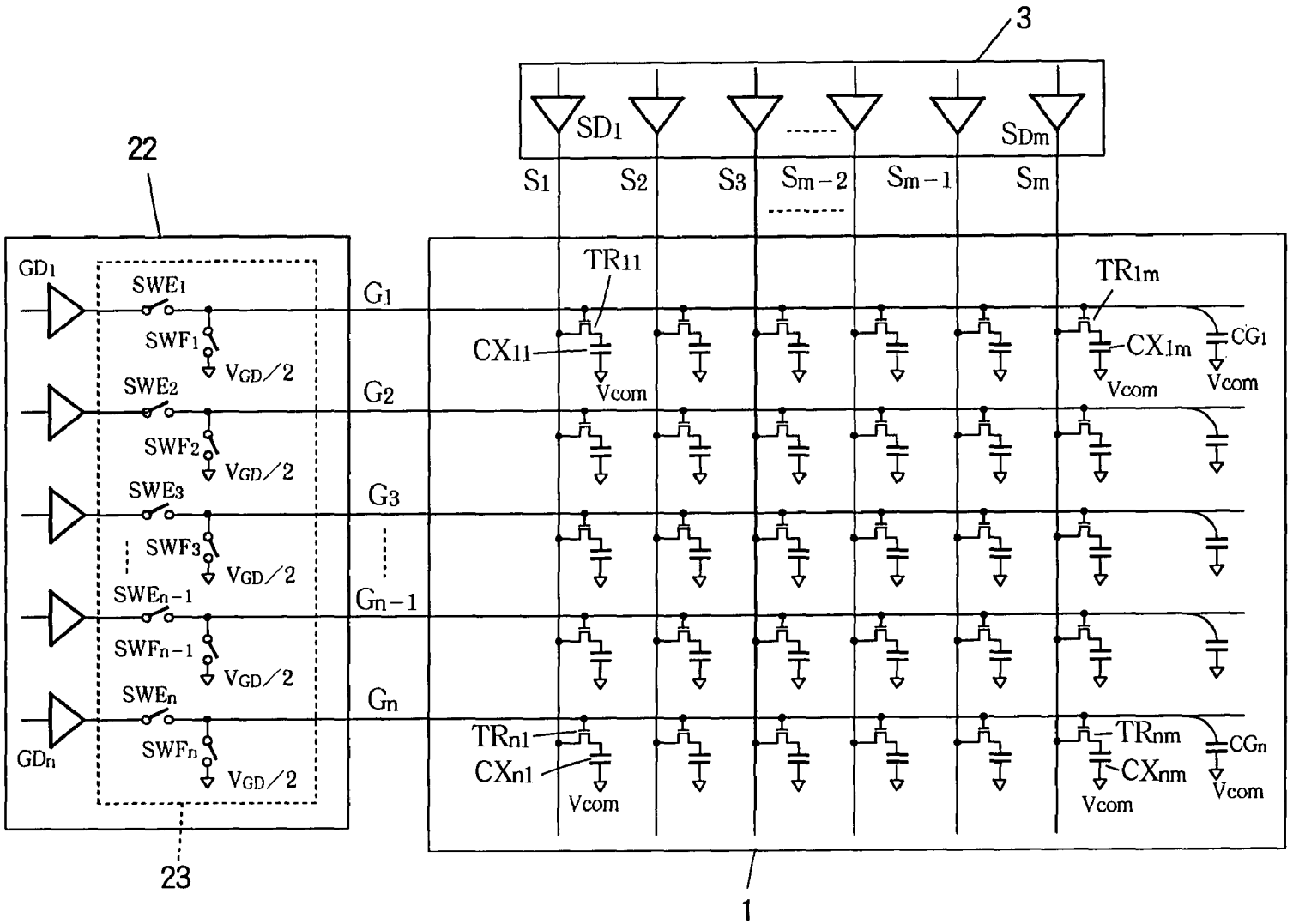
FIG. 11 is a circuit diagram of another active-matrix LCD embodying the present invention.

FIG. 11 shows an eighth embodiment of the invention. The LCD panel 1 and source-line driving circuit 3 are similar to the conventional elements in FIG. 1.

The gate-line driving circuit 22 in the eighth embodiment has a switching circuit 23 comprising switches $SWE_1$ to $SWE_n$ and $SWF_1$ to $SWF_n$. Switch $SWE_i$ couples gate line $G_i$ to gate driver $GD_i$ (i=1, . . . , n). Switch $SWF_1$ couples gate line $G_i$ to a common electrode (not visible) held at a potential $V_{GD/2}$ halfway between the high and low levels to which the gate lines are driven. Switches $SWE_i$ and $SWF_i$ comprise, for example, field-effect transistors, and can easily be added to existing gate-line driving circuit designs.

The switches $SWE_i$ and $SWF_i$ are controlled in synchronization with the gate drivers as follows. Normally, switches $SWE_i$ are all closed, and switches $SWF_i$ are all open. When the gate drivers $GD_{i-1}$ and $GD_i$ drive gate line $G_{i-1}$ from the high level to the low level and gate line $G_i$ from the low level to the high level, for a brief transition interval switches $SWE_{i-1}$ and $SWE_i$ are opened, and switches $SWF_{i-1}$ and $SWF_i$ are closed, thereby disconnecting the pair of gate lines $G_{i-1}$ and $G_i$ from gate drivers $GD_{i-1}$ and $GD_i$, and short-circuiting this pair of gate lines to the $V_{GD/2}$ electrode.

Figure 12:
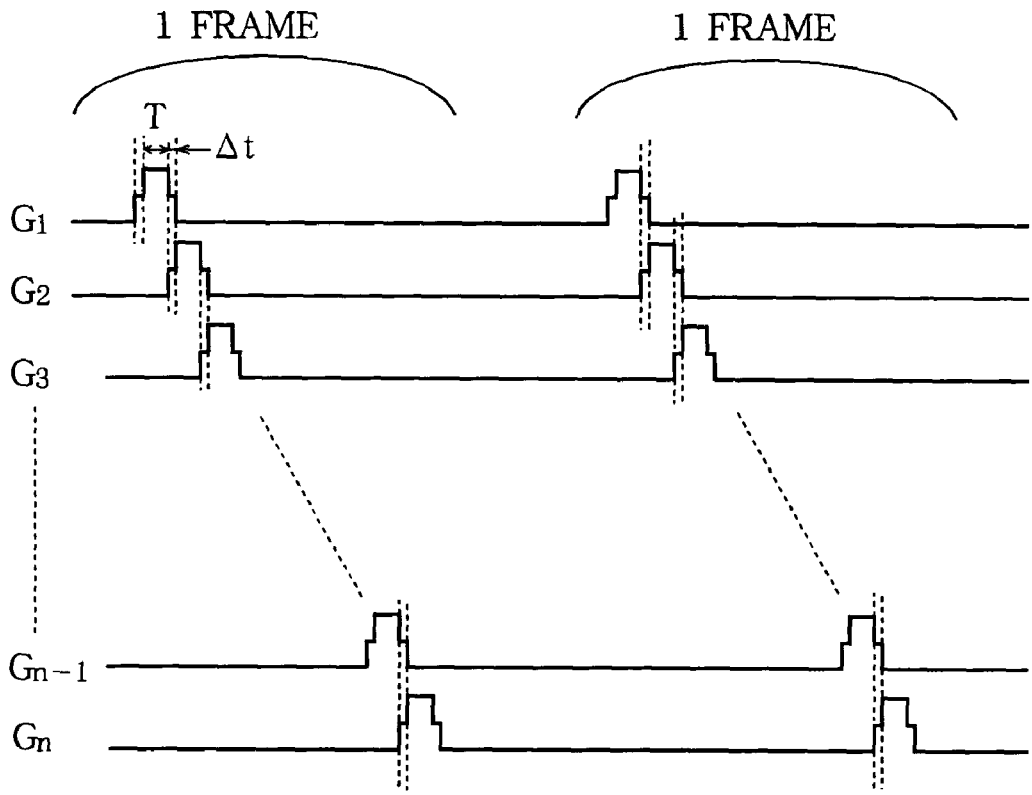
FIG. 12 is a waveform diagram illustrating the driving of the gate lines in FIG. 11.

The operation of the eighth embodiment will be described with reference to the waveform diagram in FIG. 12.

During the interval marked T, the first gate driver $GD_1$ generates the high level and the other gate drivers generate the low level.

During a transition time Δt, the first gate driver $GD_1$ changes from high to low output, and the second gate driver $GD_2$ changes from low to high output. Switches $SWE_1$ and $SWE_2$ are opened during this transition time Δt, disconnecting gate lines $G_1$ and $G_2$ from gate drivers $GD_1$ and $GD_2$. Switches $SWF_1$ and $SWF_2$ are closed during the transition time Δt, so the first gate line $G_1$ quickly discharges from the high level to the intermediate level $V_{GD/2}$, and the second gate line quickly charges from the low level to the same intermediate level $V_{GD/2}$. Charge is thereby recycled from the first gate line $G_1$ through the $V_{GD/2}$ electrode to the second gate line $G_2$.

At the end of the transition interval Δt, switches $SWF_1$ and $SWF_2$ are opened and switches $SWE_1$ and $SWE_2$ are closed, connecting gate drivers $GD_1$ and $GD_2$ to gate lines $G_1$ and $G_2$ again. Gate drivers $GD_1$ and $GD_2$ now complete the process of driving gate line $G_1$ low and gate line $G_2$ high.

A similar procedure is followed when the other gate lines are driven high and low. As a result, substantially half of the charge stored in the parasitic capacitance of each gate line is circulated to the next gate line, and the gate line drivers have to supply only half as much current as in the conventional art. Current consumption and electrical noise are thereby reduced.

The gate line drivers in the eighth embodiment require less driving capability than in the conventional art, and can be made correspondingly smaller. The size and cost of the gate-line driving circuit 22 can accordingly be reduced. These effects are obtained regardless of the driving method employed for the source lines.

Figure 13:
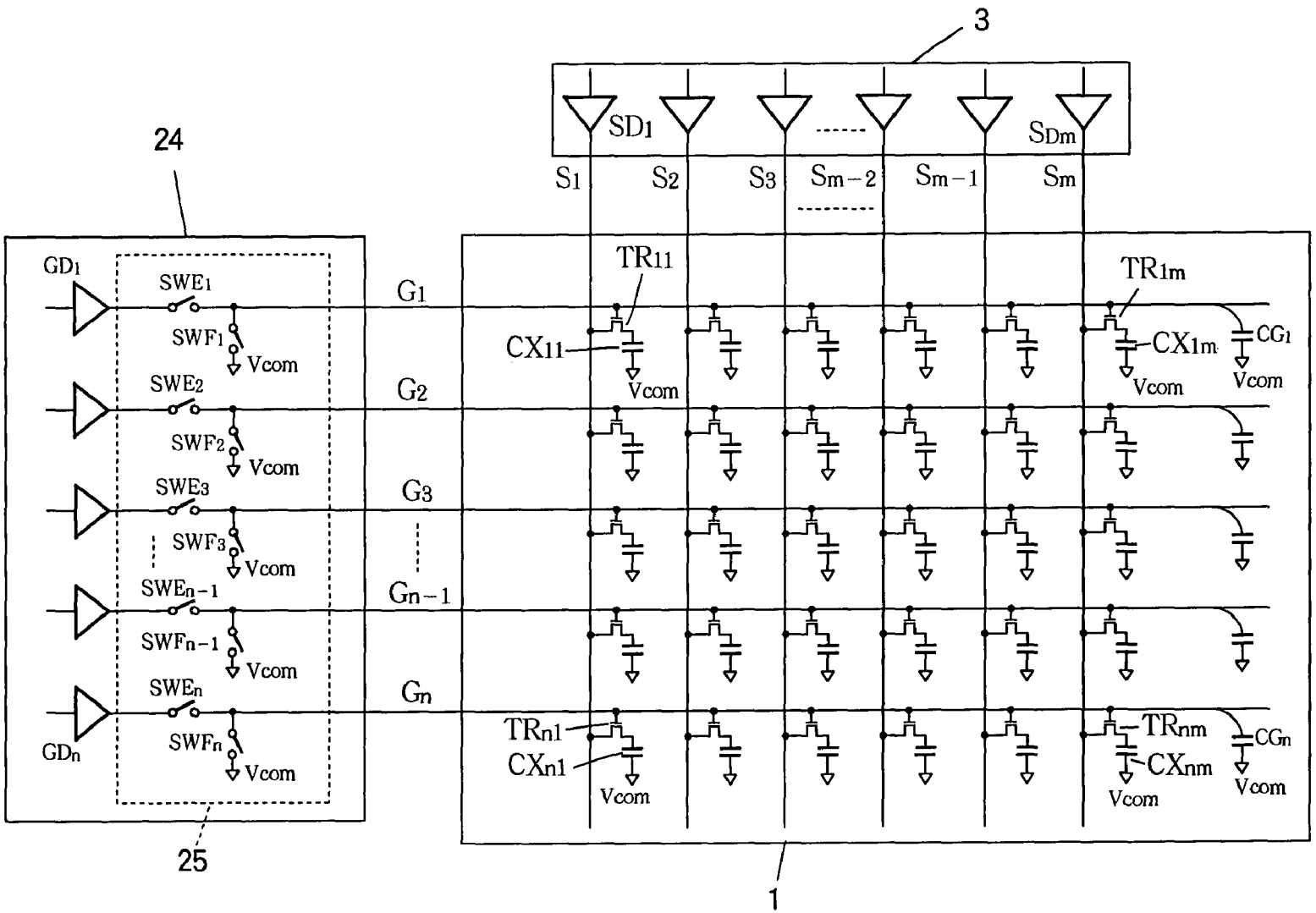
FIG. 13 is a circuit diagram of another active-matrix LCD embodying the present invention.

FIG. 13 shows a ninth embodiment of the invention. The LCD panel 1 and source-line driving circuit 3 are similar to the conventional elements in FIG. 1.

The gate-line driving circuit 24 in the ninth embodiment has a switching circuit 25 similar to the switching circuit 23 in the eighth embodiment, with switches $SWE_1$ to $SWE_n$ and $SWF_1$ to $SWF_n$, but supplies switches $SWF_1$ to $SWF_n$ with the common potential $V_{com}$ instead of $V_{GD/2}$.

Aside from this difference, the ninth embodiment operates in the same way as the eighth embodiment, so a detailed description will be omitted. If $V_{com}$ is intermediate between the high and low levels output by the gate drivers, as is normally the case, then when each gate line is driven from the high level to the low level, some of the charge stored in the parasitic capacitance of each gate line is circulated to the next gate line, permitting the driving capacity of the gate drivers, and the size and cost of the gate-line driving circuit 24, to be reduced accordingly.

Compared with the eighth embodiment, the ninth embodiment has the advantage of not requiring extra circuitry for generating the $V_{GD/2}$ potential.

Figure 14:
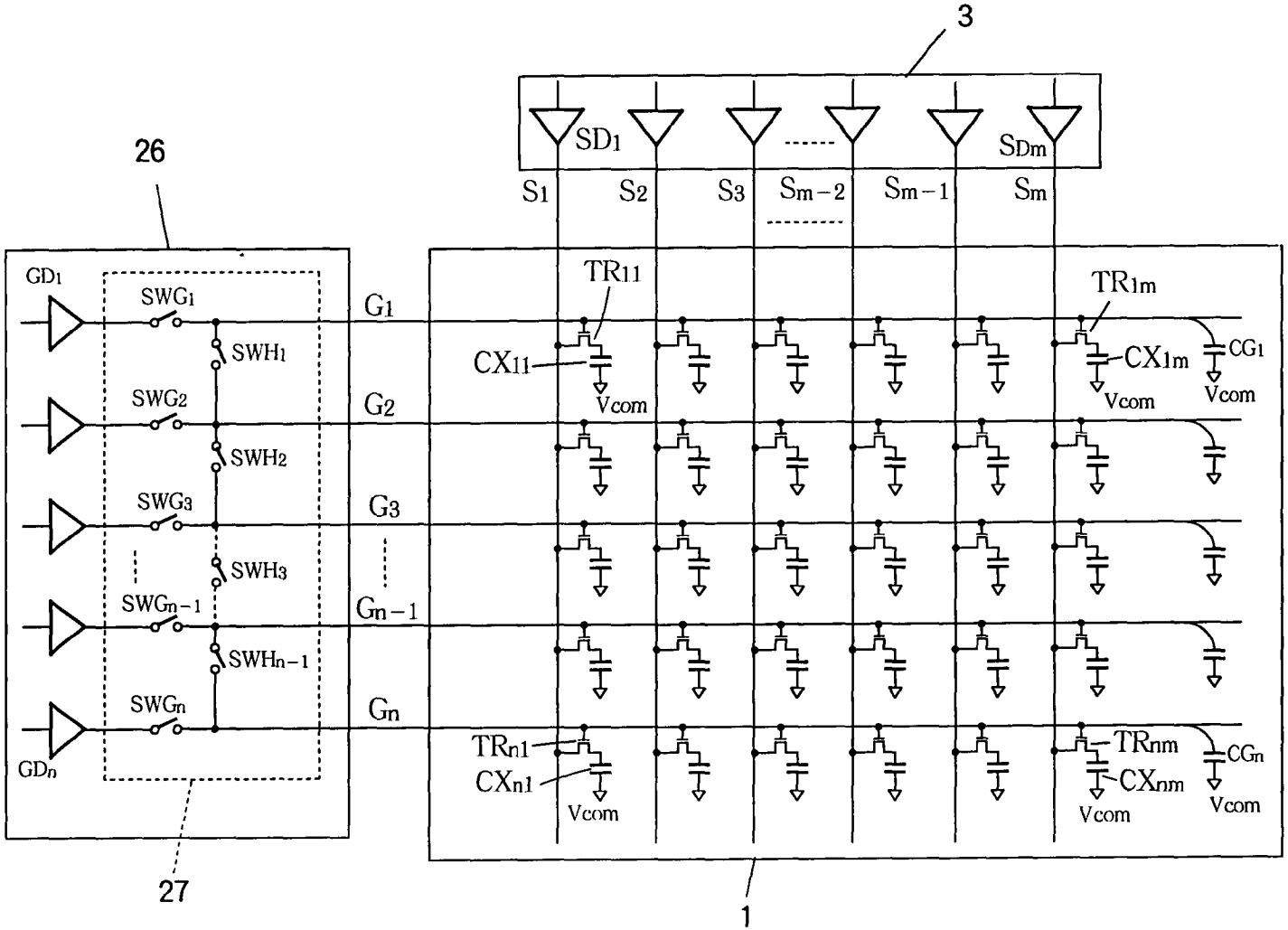
FIG. 14 is a circuit diagram of another active-matrix LCD embodying the present invention.

FIG. 14 shows a tenth embodiment of the invention. The LCD panel 1 and source-line driving circuit 3 are similar to the conventional elements in FIG. 1.

The gate-line driving circuit 26 in the tenth embodiment has a switching circuit 27 comprising switches $SWG_1$ to $SWG_n$ and $SWH_1$ to $SWH_{n-1}$. Switch $SWG_j$ couples gate line $G_j$ to gate driver $GD_j$ (j=1, . . . , n). Switch $SWH_j$ couples gate line $G_j$ to gate line $G_{j+1}$ (j=1, . . . , n−1). Switches $SWG_j$ and $SWH_j$ comprise, for example, field-effect transistors, and can easily be added to existing gate-line driving circuit designs.

The switches $SWG_j$ and $SWH_j$ are controlled as follows. Normally, switches $SWG_j$ are all closed, and switches $SWH_j$ are all open. At each transition of any pair of gate lines $G_{i-1}$ to $G_i$ between the high and low levels, for a brief interval $\Delta t$, switches $SWG_{i-1}$ and $SWG_i$ are opened and switch $SWH_{i-1}$ is closed, thereby disconnecting gate lines $G_{i-1}$ and $G_i$ from gate drivers $GD_{i-1}$ and $GD_i$ and mutually short-circuiting gate lines $G_{i-1}$ and $G_i$ to each other.

The tenth embodiment provides substantially the same effect as the eighth embodiment, by recycling substantially half the charge stored in the parasitic capacitance of gate line $G_{i-1}$ directly to gate line $G_i$. The necessary driving capacity of the gate drivers is thereby reduced, and the size and cost of the gate-line driving circuit 26 can be reduced. The tenth embodiment also has the advantage of not requiring extra circuitry for generating the $V_{GD/2}$ potential, or for supplying the common potential $V_{com}$ to the gate-line driving circuit 26.

Figure 15:
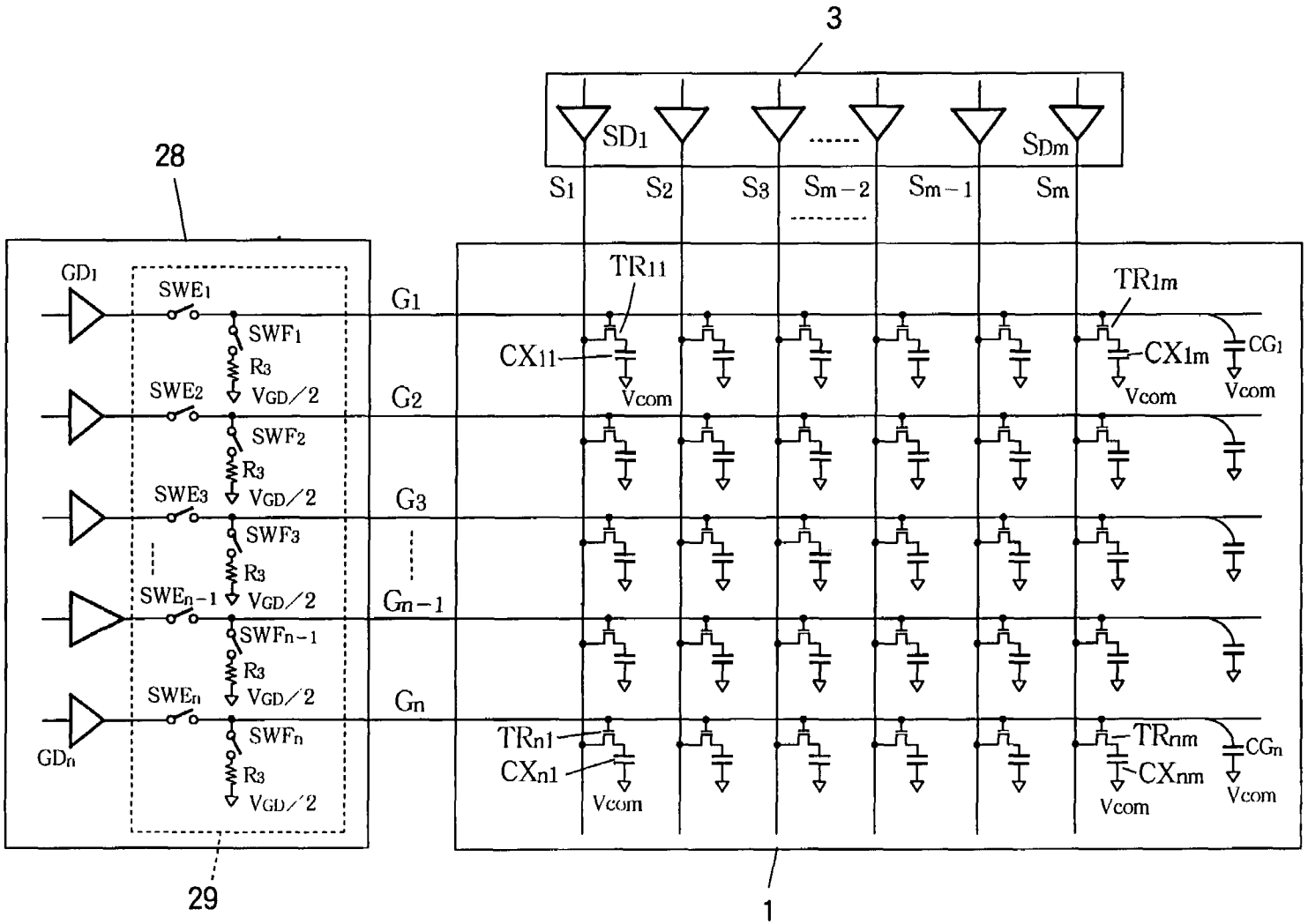
FIG. 15 is a circuit diagram of another active-matrix LCD embodying the present invention.

FIG. 15 shows an eleventh embodiment of the invention. The LCD panel 1 and source-line driving circuit 3 are similar to the conventional elements in FIG. 1.

The gate-line driving circuit 28 in the eleventh embodiment has a switching circuit 29 with the same switches $SWE_1$ to $SWE_n$ and $SWF_1$ to $SWF_n$ as in the eighth embodiment, but adds a resistor $R_3$ between each of switches $SWF_1$ to $SWF_n$ and the $V_{GD/2}$ electrode. These resistors $R_3$ comprise, for example, field-effect transistors configured to provide a certain resistance, limiting the peak current flow on the gate lines $G_1$ to $G_n$ when switches $SWF_1$ to $SWF_m$ are closed.

Resistors $R_3$ reduce voltage noise on the signal lines (not visible) that supply the intermediate potential $V_{GD/2}$ to the gate-line driving circuit 28. Voltage noise on the source lines $S_1$ and $S_m$ due to capacitive coupling with the gate lines at the points where the source lines and gate lines intersect is also reduced.

Figure 16:
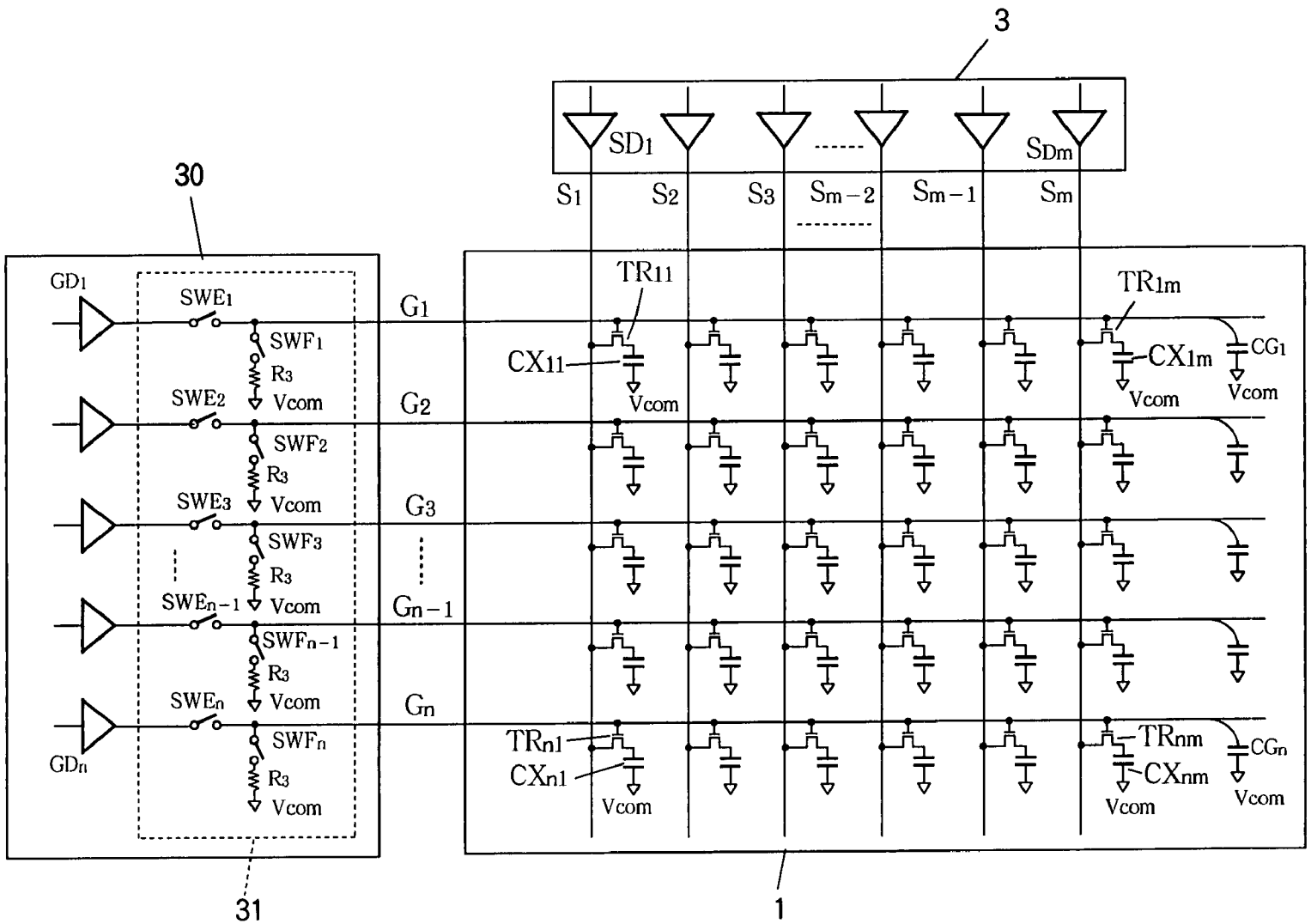
FIG. 16 is a circuit diagram of another active-matrix LCD embodying the present invention.

FIG. 16 shows a twelfth embodiment of the invention. The LCD panel 1 and source-line driving circuit 3 are similar to the conventional elements in FIG. 1.

The gate-line driving circuit 30 in the twelfth embodiment has a switching circuit 31 with the same switches $SWE_1$ to $SWE_n$ and $SWF_1$ to $SWF_n$ as in the ninth embodiment, but adds a resistor $R_3$ between each of switches $SWF_1$ to $SWF_n$ and the $V_{com}$ electrode. These resistors $R_3$ are similar to the resistors $R_3$ in the eleventh embodiment, limiting the peak current flow on the gate lines $G_1$ to $G_n$ when switches $SWF_1$ to $SWF_m$ are closed, thereby reducing voltage noise on the signal lines (not visible) that supply the common potential $V_{com}$ to the gate-line driving circuit 30, and voltage noise on the source lines $S_1$ and $S_m$ due to capacitive coupling with the gate lines.

Figure 17:
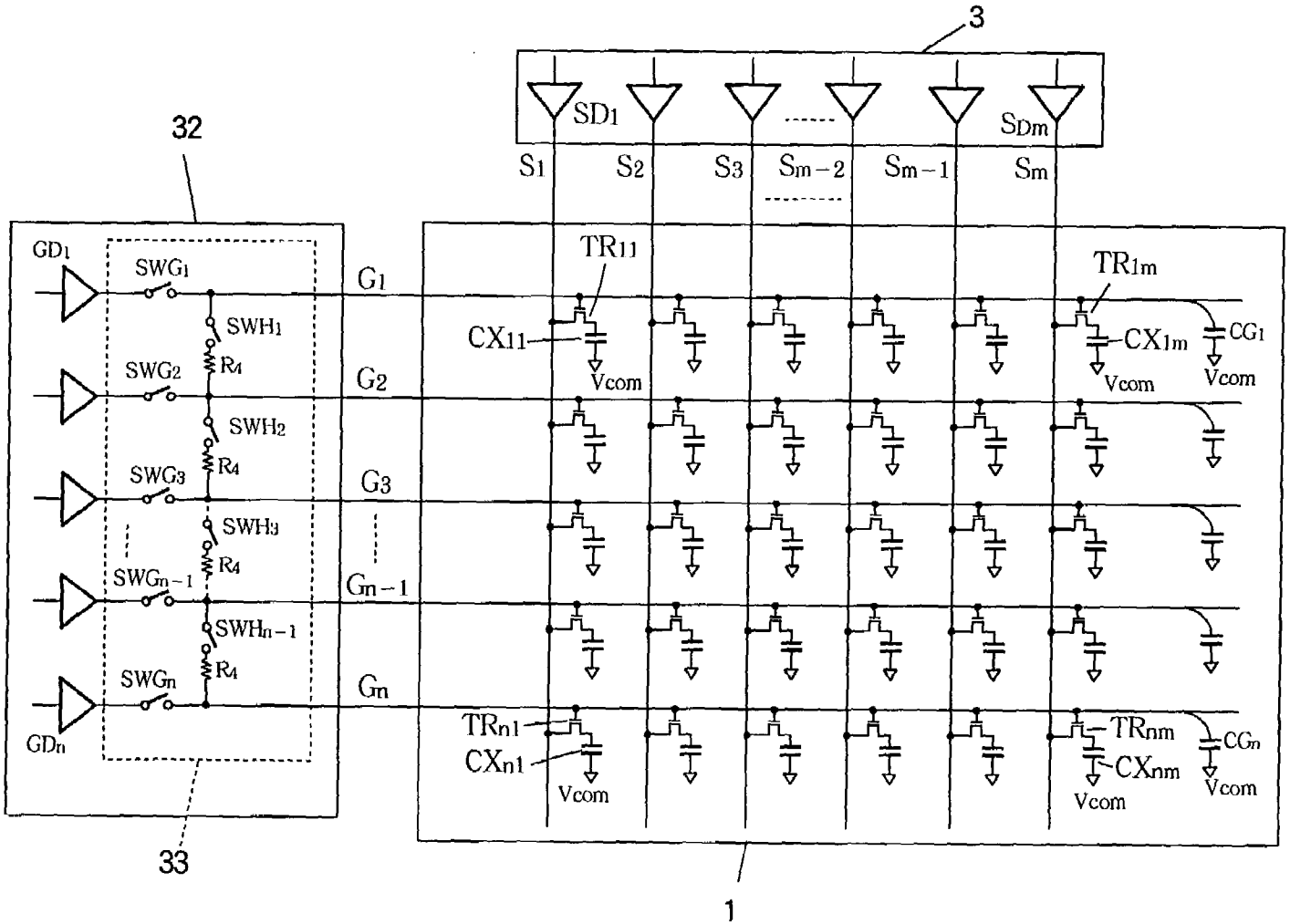
FIG. 17 is a circuit diagram of another active-matrix LCD embodying the present invention.

FIG. 17 shows a thirteenth embodiment of the invention. The LCD panel 1 and source-line driving circuit 3 are similar to the conventional elements in FIG. 1.

The gate-line driving circuit 32 in the thirteenth embodiment has a switching circuit 33 with the same switches $SWG_1$ to $SWG_n$ and $SWH_1$ to $SWH_{n-1}$ as in the tenth embodiment, but adds a resistor $R_4$ between each switch $SWH_i$ and gate line $G_{i+1}$ (i=1, . . . , n−1). These resistors $R_4$ are similar to the resistors $R_3$ in the eleventh and twelfth embodiments, limiting the peak current flow on the gate lines $G_1$ and $G_{i+1}$ when switch $SWH_i$ is closed, thereby reducing voltage noise on the source lines $S_1$ and $S_m$ due to capacitive coupling with the gate lines.

The eleventh, twelfth, and thirteenth embodiments provide the same effects as the eight, ninth, and tenth embodiments, respectively, with the added effect of a reduction in electrical noise.

Any of the eighth to thirteenth embodiments can be combined with any of the first to seventh embodiments to reduce current consumption, electrical noise, size, and cost in both the source-line driving circuits and the gate-line driving circuits.

Applications of the present invention are not limited to portable computers. The invention can be practiced in driving circuits for various types of liquid-crystal displays, including LCD flat-panel television sets, and projection television sets with liquid-crystal light valves.

The switching elements in the LCD panel need not be thin-film transistors. The invented driving circuits can also be used to drive LCD panels employing thin-film diode switching elements, metal-insulator-metal (MIM) switching elements, and various other types of nonlinear switching elements. Depending on the types of switching elements employed, the signal lines in the matrix may have names other than source lines and gate lines.

The driving methods are not limited to the waveforms shown in the drawings. The gate driving signals may be active low instead of active high. The eighth to thirteenth embodiments can reduce the required driving capability of a driving circuit that drives the gate lines or equivalent lines in any type of LCD matrix, whether active or not.

Those skilled in the art will recognize that further variations are possible within the scope claimed below.

What is claimed is:

1. A method of driving a liquid-crystal display having a matrix of first signal lines aligned in a first direction and second signal lines aligned in a second direction transverse to the first direction, a plurality of switching elements controlled by the first signal lines, disposed at intersections of the first signal lines with the second signal lines, and a plurality of liquid-crystal capacitors disposed at said intersections and coupled through said switching elements to said second signal lines, comprising the steps of:

sequentially driving said first signal lines to active and inactive levels, thereby switching said switching elements on and off at certain transition times, said first signal lines being driven to the active level only one at a time;

equalizing the potentials of all of said second signal lines during said transition times; and driving one of said second signal lines with signals representing picture-element intensities while said first signal lines are being driven to the active level;

wherein said signals representing picture-element intensities alternate between potentials on one side of a certain center potential and potentials on an opposite side of said center potential at predetermined intervals, a plurality of said first signal lines being driven consecutively to the active level during each of said predetermined intervals.

2. The method of claim 1, wherein equalizing the potentials includes short-circuiting said second signal lines to each other.

3. The method of claim 1, wherein equalizing the potentials includes connecting said second signal lines to a fixed potential.

4. A method of driving a liquid-crystal display having a matrix of first signal lines aligned in a first direction and second signal lines aligned in a second direction transverse to the first direction, a plurality of switching elements controlled by the first signal lines, disposed at intersections of the first signal lines with the second signal lines, and a plurality of liquid-crystal capacitors disposed at said intersections and coupled through said switching elements to said second signal lines, comprising the steps of:

sequentially driving said first signal lines to active and inactive levels, thereby switching said switching elements on and off at certain transition times, said first signal lines being driven to the active level only one at a time;

equalizing the potentials of a pair of said first signal lines to an intermediate level intermediate between the active and inactive levels when both of the first signal lines in said pair are undergoing transitions between said active and inactive levels; and driving one of said second signal lines with signals representing picture-element intensities while said first signal lines are being driven to the active level;

wherein said signals representing picture-element intensities alternate between potentials on one side of a certain center potential and potentials on an opposite side of said center potential at predetermined intervals, a plurality of said first signal lines being driven consecutively to the active level during each of said predetermined intervals.

5. The method of claim 4, wherein equalizing the potentials includes short-circuiting said pair of said first signal lines to each other.

6. The method of claim 4, wherein equalizing the potentials includes connecting said pair of said first signal lines to a fixed potential.

* * * * *

UNITED STATES PATENT AND TRADEMARK OFFICE

CERTIFICATE OF CORRECTION

PATENT NO. : 7,304,632 B2
APPLICATION NO. : 10/650796
DATED : December 4, 2007
INVENTOR(S) : Hidetaka Kodama et al.

It is certified that error appears in the above-identified patent and that said Letters Patent is hereby corrected as shown below:

On the title page:
Please insert the following item after (65) Prior Publication Data and before Related U.S. Application Data:

(30) Foreign Application Priority Data
May 13, 1997 (JP)……..122284/97
March 24, 1998 (JP)…....75136/98

Signed and Sealed this

Eighth Day of April, 2008

JON W. DUDAS
*Director of the United States Patent and Trademark Office*

UNITED STATES PATENT AND TRADEMARK OFFICE

CERTIFICATE OF CORRECTION

PATENT NO. : 7,304,632 B2
APPLICATION NO. : 10/650796
DATED : December 4, 2007
INVENTOR(S) : Hidetaka Kodama et al.

It is certified that error appears in the above-identified patent and that said Letters Patent is hereby corrected as shown below:

Title page,
Item [63], should read,
--Related U.S. Application Data
Continuation of application No. 09/718,620, filed on Nov. 24, 2000, now Pat. No. 6,642,916, which is a division of application No. 09/070,244, filed May 1, 1998.--

Signed and Sealed this
Eighteenth Day of December, 2012

David J. Kappos

David J. Kappos
*Director of the United States Patent and Trademark Office*